US006976371B2

(12) United States Patent
Gleason et al.

(10) Patent No.: US 6,976,371 B2
(45) Date of Patent: Dec. 20, 2005

(54) PORTABLE FOOD COOLING CONTAINER

(76) Inventors: Patrick T. Gleason, 5441 Hisey Ranch Rd., Acton, CA (US) 93510; Penny A. Gleason, 5441 Hisey Ranch Rd., Acton, CA (US) 93510

( * ) Notice: Subject to any disclaimer, the term of this patent is extended or adjusted under 35 U.S.C. 154(b) by 93 days.

(21) Appl. No.: 10/765,590

(22) Filed: Jan. 26, 2004

(65) Prior Publication Data

US 2004/0194496 A1 Oct. 7, 2004

Related U.S. Application Data

(63) Continuation-in-part of application No. 10/407,717, filed on Apr. 4, 2003.

(51) Int. Cl.[7] ..... F25B 21/00
(52) U.S. Cl. ..... 62/457.9; 62/3.6; 62/457.1
(58) Field of Search ..... 62/457.9, 457.1, 62/457.5, 457.6, 457.7, 3.6, 3.62

(56) References Cited

U.S. PATENT DOCUMENTS 355,848 A * 1/1887 Johnson ..... 72/194
3,710,589 A 1/1973 Brown et al.
5,189,282 A * 2/1993 Rocha et al. ..... 219/467.1
5,423,194 A 6/1995 Senecal
5,718,124 A 2/1998 Senecal
6,032,481 A * 3/2000 Mosby ..... 62/457.2
6,119,461 A * 9/2000 Stevick et al. ..... 62/3.64
6,295,820 B1 10/2001 Cauchy et al.
6,658,858 B1 * 12/2003 Thompson et al. ..... 62/3.6

* cited by examiner

*Primary Examiner*—Melvin Jones
(74) *Attorney, Agent, or Firm*—Aaron T. Borrowman; Kelly Lowry & Kelley, LLP

(57) ABSTRACT

A portable refrigeration apparatus includes a base defining an open interior cavity. An electric refrigeration unit is operably disposed in the base for cooling the contents of the interior cavity. A food container is configured to be removably disposed within the interior cavity of the base such that the cooled air is prevented from entering the food container and instead is trapped and circulated within the interior cavity surrounding the food container. A lid is positionable over the food container and configured to be removably placed onto an upper edge of the base or onto the food container to form a generally air-tight seal therebetween.

39 Claims, 7 Drawing Sheets

PORTABLE FOOD COOLING CONTAINER

RELATED APPLICATION

This application is a continuation-in-part of U.S. patent application Ser. No. 10/407,717, filed Apr. 4, 2003.

BACKGROUND OF THE INVENTION

The present invention generally relates to refrigeration units. More particularly, the present invention relates to a food cooling container which is designed in size so as to be portable for placement on counter tops, used for picnics, pot-luck events and the like.

While the refrigerator is an excellent tool for keeping perishable food items fresh, there are certain drawbacks associated with their use. Foremost is the fact that the perishable foods must be kept inside the refrigerator in order to last any period of time. However, items such as fruit and vegetables which are stored in areas of the refrigerator which are not readily seen or frequently accessed can go unnoticed until they begin to spoil. However, placing fruit or vegetables on a kitchen counter, while more easily noticed, severely limits their life span as spoilage occurs at a faster rate. Moreover, such foods are often more desirable when cool. Furthermore, salad greens and vegetables tend to wilt and dry out when stored in conventional vessels.

Similar problems are often encountered while hosting a dinner, or during pot-luck events. Lettuce tends to wilt and cheese dries out when serving such perishables in the traditional manner. Foods containing mayonnaise, eggs, or milk are particularly susceptible to food spoilage even within an hour or two. In restaurants and other places with self-service buffets, tables and counters are often provided with cooling wells in the table or counter top for such food that must be kept cold to preserve its quality. Such cooling wells comprise box-shaped recesses or depressions in a table or counter top with external surrounding cooling tubes or a cooling jacket. However, such commercial cooling wells are often not available to the typical home owner or dinner host. Moreover, such cooling wells and tables are very expensive, occupy a significant amount of space, are not portable and also have disadvantages. For example, even in such restaurant settings, the displayed food will gradually become wilted, dried out or otherwise drab and unappetizing.

Picnics and cookouts are popular recreational pastimes during the summer months. Oftentimes, food is catered, such as to the movie industry, in an outdoor setting as well. A potential hazard for outdoor eating, however, is food spoilage. Such foods are often kept in a picnic cooler up until serving time. However, once people begin to eat, such foods are usually moved from the cooler and placed on the serving table, where it may sit for several hours while people eat, talk, play games, etc. Particularly in the summer months, the food is very susceptible to drying out, wilting and spoilage.

Attempts have been made in the past to overcome these problems. For example, U.S. Pat. No. 4,520,633 relates to a salad bowl having a relatively flat interior partition separating the bowl into an upper food containing receptacle and a lower ice-containing chamber. U.S. Pat. No. 5,345,784 discloses a salad bowl comprising interior and exterior bowls, with a cooling chamber filled with cold water or the like therebetween. However, these devices only serve to keep food cool for a very short period of time. Moreover, these devices do not address the problems associated with wilting and drying of the surface of the food to be served. Moreover, these devices can be messy in that the water can spill from these devices on the serving table as the food is removed from the containers, or they are transported.

Accordingly, there is a continuing need for a food cooling container which overcomes the problems discussed above and takes into account the drawbacks associated with prior devices and systems. The present invention fulfills these needs and provides other related advantages.

SUMMARY OF THE INVENTION

The present invention resides in a portable refrigeration apparatus which is sized such so as to be placed upon one's counter top, or even transported in one's car or the like. The refrigeration apparatus of the present invention can be used for prolonged periods of time so long as a power source, such as an electrical outlet or battery power, is supplied thereto. The apparatus of the present invention is intended to overcome the problems associated with forgotten food in refrigerators, unappetizing drying and wilting of exposed foods, as well as spoilage of foods left out for prolonged periods of time.

The refrigeration apparatus of the present invention generally comprises a base having a circumferential wall defining an open interior cavity. Typically, the base has an outer wall and an inner wall which is spaced therefrom. The base is preferably insulated, and may comprise a dual outer wall having an insulating space therebetween. An electric refrigeration unit is operably disposed in the base for cooling the contents of the interior cavity. The refrigeration unit typically comprises a compressor, a cooling coil coupled to the compressor, and a fan for directing cool air into the interior cavity. The refrigeration unit may comprise other types of units, such as a thermoelectric couple device. A temperature control mechanism and dial may be coupled to the refrigeration unit to alter the temperature of the interior cavity.

A food container is provided which is configured to be removably disposed within the interior cavity of the base in a generally sealed relationship therewith. An upper portion of the food container engages with an upper portion of the base to form a seal to prevent cool air from passing therebetween and over and into the food container. Preferably, an upper lip of the food container sealingly engages with an upper lip or rim of the base. The food container may also be compartmentalized to accommodate different food items.

In a particularly preferred embodiment, the base is generally concave and at least a portion of the inner wall includes apertures for permitting cool air to flow therethrough and onto an outer surface of the food container. Typically, a first portion of the inner wall includes air outlet apertures, and a second portion of the inner wall, spaced from the first portion, includes inlet apertures to facilitate air circulation.

A lid is positionable over the food container, and is preferably configured to form a generally air-tight seal between it and an upper edge of the base or food container.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 3:
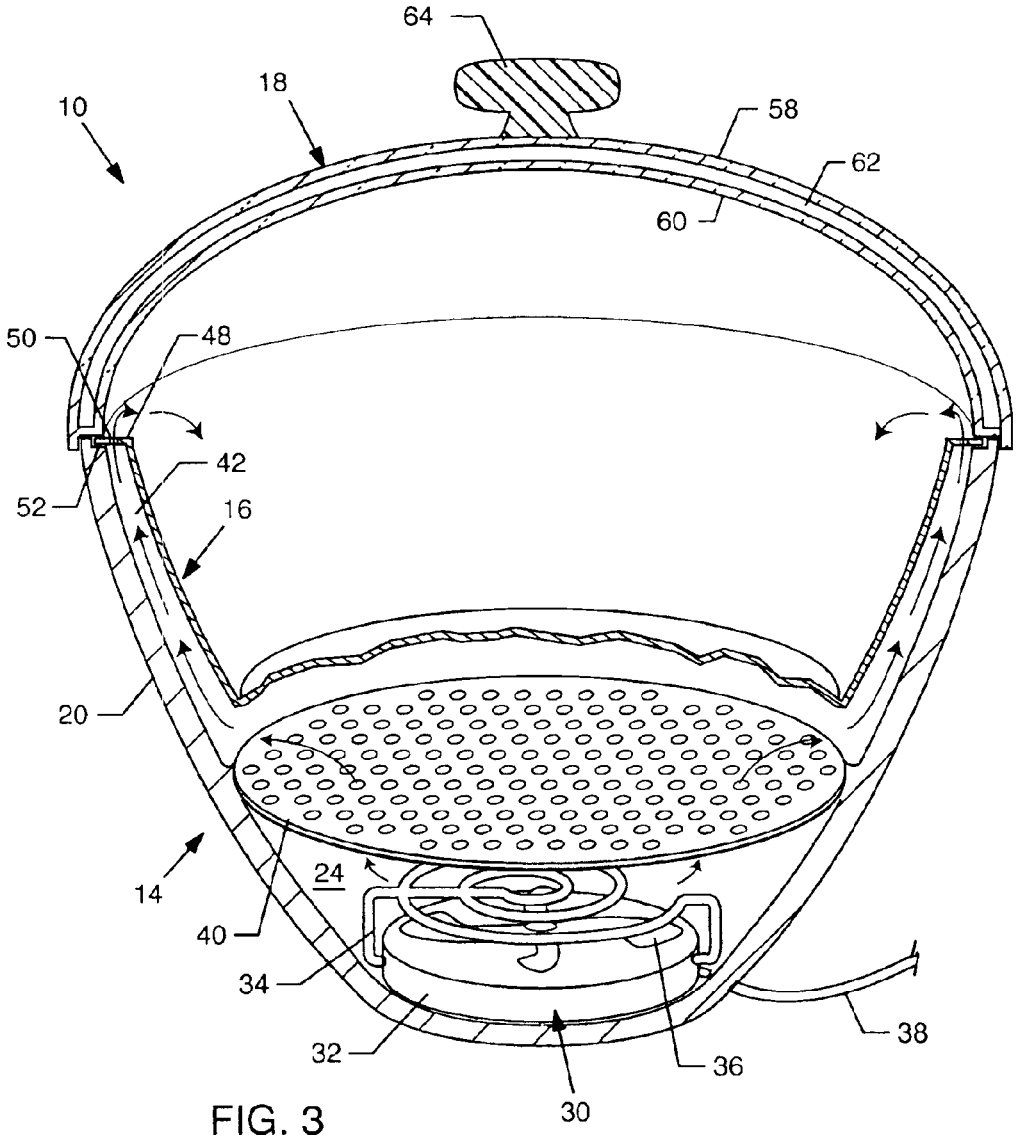
FIG. 3 is a cross-sectional view taken generally along line 3—3 of FIG. 1, illustrating the flow of cool air generated by a refrigeration of the apparatus.
Figure 4:
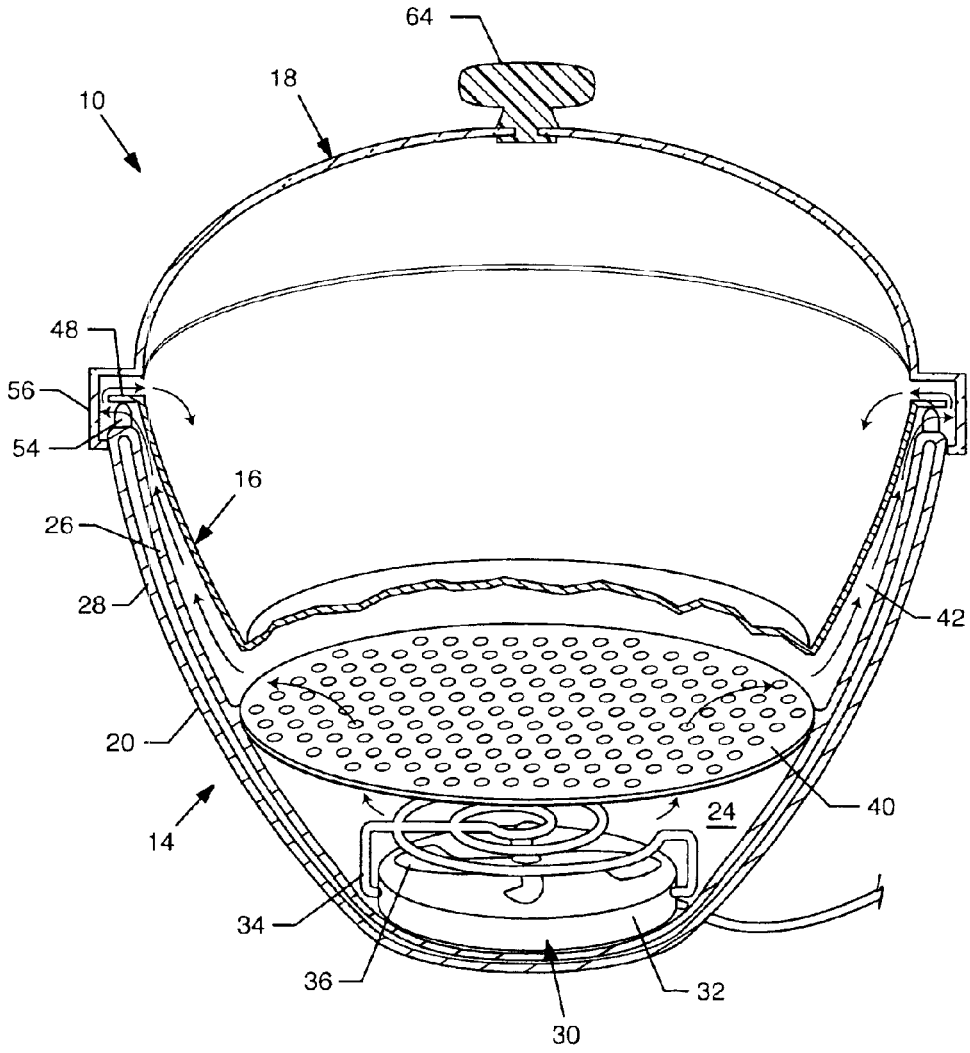
FIG. 4 is a cross-sectional view of the apparatus similar to FIG. 3, illustrating another vent means used in accordance with the present invention.
Figure 5:
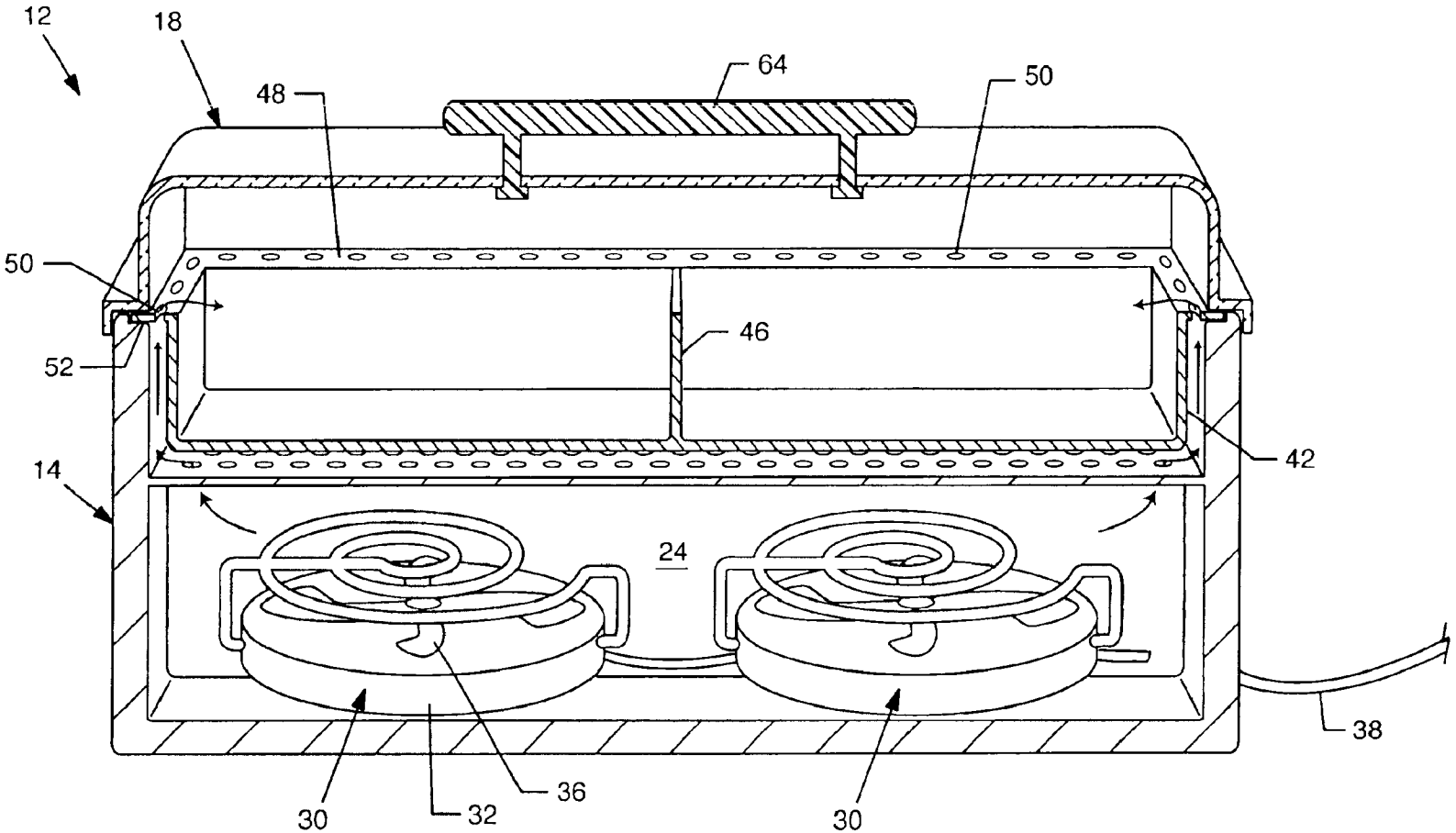
FIG. 5 is a cross-sectional view of yet another refrigeration apparatus embodying the present invention, having a generally rectangular configuration and multiple refrigeration units therein.

As shown in the accompanying drawings for purposes of illustration, the present invention resides in a refrigeration apparatus, generally referred to by the reference number 10 in FIGS. 1–4, and by the reference number 12 in FIG. 5. As will be more fully described herein, the refrigeration apparatus 10 and 12 is designed so as to be portable for conveniently holding food items to be refrigerated on a counter or serving table for prolonged periods of time.

Figure 1:
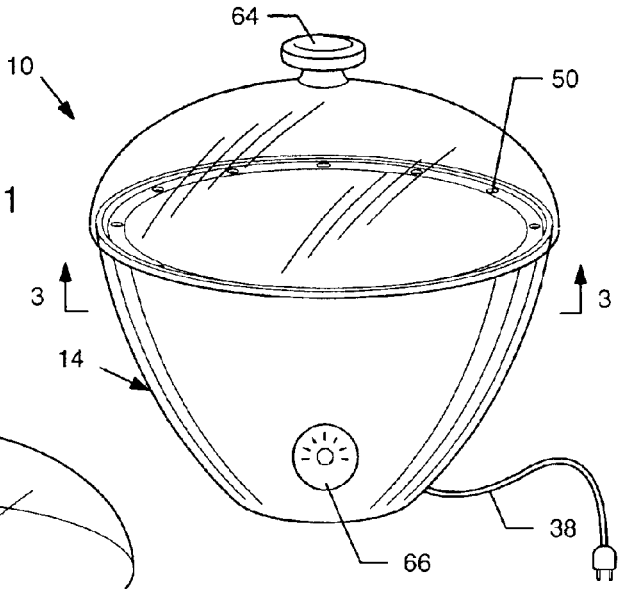
FIG. 1 is a perspective view of a portable food cooling container embodying the present invention.
Figure 2:
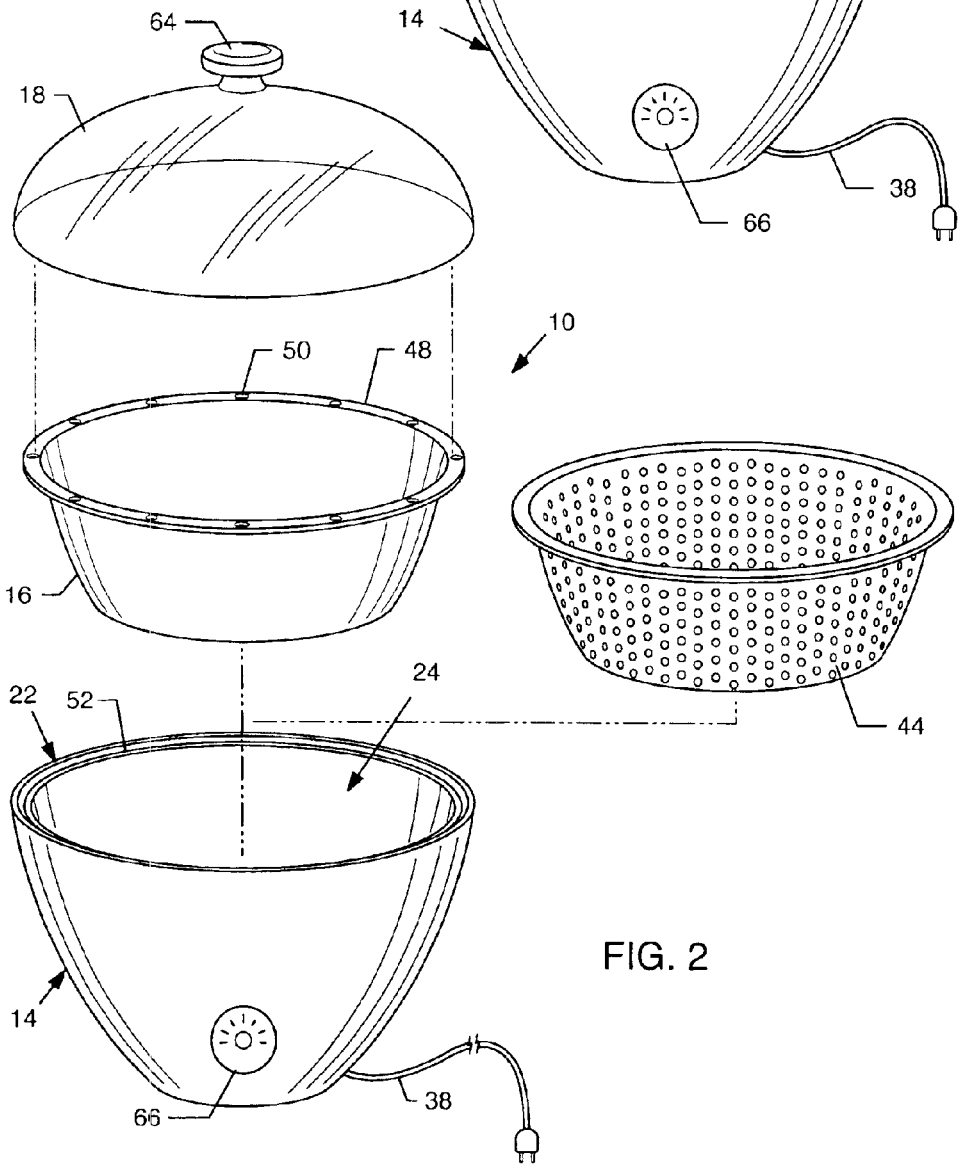
FIG. 2 is a partially exploded perspective view of the food container of FIG. 1, illustrating the use of either a solid or apertured food container.

With reference to FIGS. 1 and 2, the apparatus 10 is generally comprised of a base 14 which removably supports a food container 16 and a lid 18 which is designed to be placed over the food container 16 and in a particularly preferred embodiment form a generally air-tight seal between it and the base 14 to retain cool air within the apparatus 10. The apparatus 10 is sized such so as to be stored on a counter top or easily placed on a serving table or the like. The apparatus 10 can be of many different configurations, although it is typically a bowl-shaped, square or rectangular pan-shaped configuration.

With reference now to FIGS. 1–4, the base 14 is comprised of a circumferential wall 20 having an upper edge 22 which is configured to support the food container 16 thereon. Thus, the base 14 defines an internal cavity 24 which is open to the environment. The wall 20 may be comprised of an insulating type material, or have insulative material attached to an inner surface thereof. Typically, the base 14 is comprised of a metal material, although such can vary and incorporate plastics or earthware as deemed appropriate. The base 14 in a particularly preferred embodiment, as illustrated in FIG. 4, is comprised of an outer wall 20 and an inner wall 26 having an insulative space 28 therebetween so that cold air is not released to the environment, as will be described more fully herein.

With particular reference to FIGS. 3 and 4, a refrigeration unit 30 is disposed within the base for cooling the internal cavity 24 thereof. The refrigeration unit 30 may be comprised of a compressor 32 operably connected to a cooling coil 34 such that the air with the internal cavity 24 is cooled. Preferably, the refrigeration unit 30 includes a fan 36 for passing air over the condensing coil 34 so as to circulate the cooled air. It will be appreciated by those skilled in the art, that other refrigeration units which are known in the art could be substituted for the cooling unit 30 described above. An electrical cord 38 extends from the refrigeration unit 30 for powering the apparatus 10, such as by a household 110 volt electrical outlet. It will also be appreciated by those skilled in the art that the present invention can include an adapter such that the apparatus 10 can be powered by a cigarette lighter of an automobile, or by an alternative power source, such as a battery. In this manner, cool air can be created within the internal cavity 24 while in the car such as when transporting the food to a potluck dinner, picnic, etc. Battery power may be desirable in certain other instances, such as outdoor catering and the like.

With continuing reference to FIGS. 3 and 4, an apertured wall 40 is disposed in a lower portion of the base 14 above the refrigeration unit 30, or formed integrally with the base 14 so as to protect the refrigeration unit 30 while allowing air (shown by the arrows) to flow therethrough. Such wall 40 is optional, instead the food container 16 can be configured such so as to not make contact with refrigeration unit 30 under virtually any circumstance. However, wall 40 serves not only to protect refrigeration unit 30, but also prevent small items from dropping onto refrigeration unit 30, or children's fingers from being harmed by fan 36.

The food container 16 is comprised of any suitable material, including metal or plastic or ceramic material. The food container 16 is generally configured so as to substantially mate with an inner surface of base 14. Typically, the food container 16 is sized such that a small gap 42 defining an air passageway is formed between an outer surface thereof and an inner surface of the base 14 such that cool air can flow therebetween and cool the entire outer surface of the container 16, and thus the food therein.

A bowl-shaped container 16 is illustrated in FIGS. 1–4. However, the container is not restricted to this configuration and can be generally rectangular, as illustrated in FIG. 5, or of any other configuration so long as it is removably disposed within base 14. The container may include a plurality of apertures so as to form a colander-like container 44, as illustrated in FIG. 2. Such container is particularly useful for vegetables and fruit. However, for wetter food items, such as Jell-O, ambrosia, casseroles or salads, the container 16 is solid in construction so as not to allow the food contents thereof to leak into the base 14. The container 16 can be of varying depths so as to accommodate different foods. For example, the container 16 can be relatively shallow so as to serve as a relish tray or the like. The container 16 may include internal walls 46 for creating compartments for the placement of different food items, as shown in FIG. 5. For example, in a relish tray container, a central portion can define a dip compartment, with separate compartments for olives, carrot sticks, etc. Even deeper dish containers 16 could include such internal walls 46 so that different salads can be maintained in the same unit 10 or 12.

In one embodiment, the apparatus 10 includes vents so that the cool air can travel above the food container 16 to cool the upper surface of food stored therein, as well as from below. As illustrated in FIGS. 2, 3 and 5, an upper rim 48 of the food container 16 can include vent apertures 50. The rim 48 rests upon a ledge 52 or shoulder formed on the upper rim 22 of the base 14. Cool air flowing within gap 42 is allowed to flow through vent apertures 50 above the container 16 as the vent apertures 50 are not occluded by the ledge 52. Rather, the outermost edge of rim 48 rests securely on the shoulder 52 of the base 14.

The present invention contemplates other means of providing such venting. For example, as illustrated in FIG. 4, the upper edge of rim 22 can include an irregular surface, such as the illustrated protrusions 54, which create air gaps between the rim 48 and ledge 22, such that air can flow therethrough and around the rim 48 of the container 16 so that cool air is introduced above the container 16. In such instance, the lower edge 56 of the lid 18 is configured so as to engage an outer surface of the base 14 and provide an air passageway around the rim 48 of the container 16. Yet other means may be used, as would be appreciated by those skilled in the art, for creating such vent means.

The lid 18 is preferably comprised of a durable and transparent or translucent material, such as glass or plastic. Preferably, the lid 18 is comprised of a material that has insulating qualities to maintain the cool internal cavity temperature. As illustrated in FIG. 3, the lid 18 may in fact comprise a dual pane lid having two walls 58 and 60 with an insulating space 62 therebetween. The lowermost edge of the lid 18 cooperatively mates with the rim 22 of base 14 such that the contents of the container 16 are covered. Preferably, the lid 18 and base 14 form a generally air-tight seal therebetween for maintaining the internal temperature of the apparatus 10. Rubber gaskets or seals may be used to facilitate this characteristic. A handle 64 is formed with or otherwise attached to the lid 18 to allow its easy removal of the lid 18 from base 14 to access the food within container 16.

A thermostat 66, or other temperature control mechanism, is preferably coupled to the refrigeration unit 30 so as to control the temperature within the apparatus 10. The temperature controlled mechanism 66 preferably includes a sending unit or temperature sensor which can detect the temperature within the apparatus 10 to determine that the desired temperature is achieved and maintained and for turning on the cooling unit 30 if the temperature exceeds the desired and preset temperature. Thus, food within container 16 can be cooled to varying temperatures to prevent spoilage thereof, while increasing efficiency of the unit. The use of a thermostatically controlled apparatus 10 having a generally air-tight seal enables the apparatus 10 to be placed on a counter top and run continually 24 hours a day while maintaining its energy efficiency. Of course, the thermostat 66 can be used to quickly cool the internal cavity 24, and then be adjusted later to merely keep the food cool to increase energy efficiency.

Figure 6:
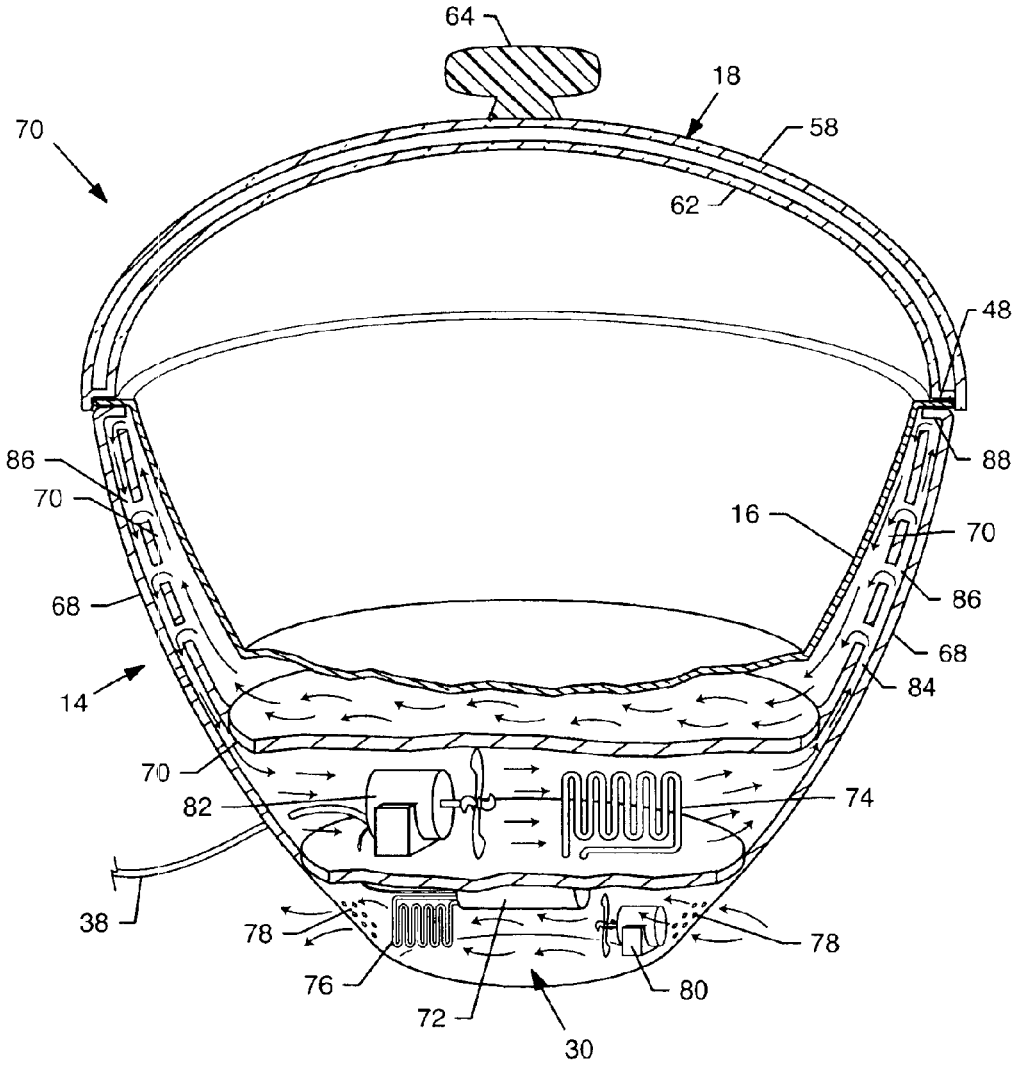
FIG. 6 is a cross-sectional view illustrating another portable refrigeration apparatus embodying the present invention which is designed to circulate air around an outer surface of the food container.
Figure 7:
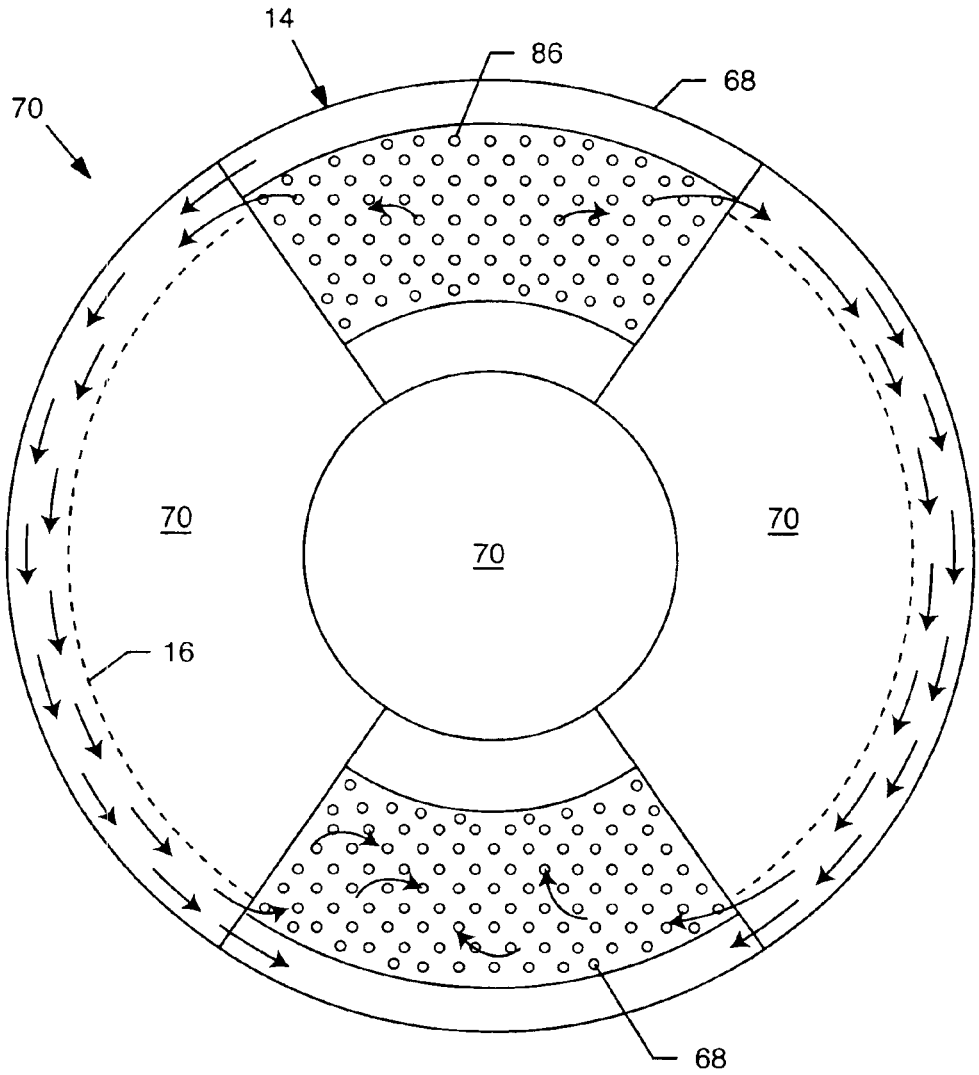
FIG. 7 is a top plan view of the apparatus of FIG. 6, without the lid, illustrating circulation of air within a base and around the food container in accordance with the present invention.

With reference now to FIGS. 6 and 7, another embodiment of the apparatus 70 is illustrated which is specifically designed to prevent cooled air from flowing into or above the food container 16 as such air flow can cause, e.g. lettuce to wilt, sauce-based goods to develop a film or crust, or otherwise render the food unappealing. Thus, this embodiment is intended to seal the food within the food container 16 to the extent possible while still cooling the food.

The base 14 in this embodiment has an insulated outer wall 68. Such wall 68 may be comprised of insulated material, have lining of insulation, or may be dual-pane so as to have a space of air or other material therebetween for insulation purposes so as to render the apparatus 70 efficient and retain the cold temperature within the base 14. An inner wall 70 is spaced apart from the outer wall 68. The inner wall 70 defines the interior cavity of the apparatus 70 in which the food container 16 is disposed.

A refrigeration unit 30 is associated with the base 14, typically disposed in the lower portion of the base between the inner and outer walls 68 and 70 or within a separate compartment thereof. The refrigeration unit 30 may comprise a compressor 72 operably connected to a refrigeration coil 74 having a heat sink 76 or heat sink coils. Preferably, the base 14 includes apertures 78 which enable the hot air to escape from the heat sink coil 76 and operation of the compressor 72. A first fan 80 may be used to facilitate this air flow. A second fan 82 is preferably used to circulate air over the cooling coils 74 and throughout the base unit 14. It will be appreciated by those skilled in the art that other refrigeration unit devices 30 may be substituted for this arrangement. For example, at least one thermoelectric couple could be placed within the base 14 so as to remove heat from the circulated air when a current is applied thereto. Such peltier effect thermoelectric modules or couples typically use a cold sink and an opposite heat sink for cooling the air supply. U.S. Pat. No. 5,718,124 discloses such a thermoelectric device, the contents of which are incorporated by reference herein.

The air within the base 14 is passed over the cooling coil 74, within the space 84 between the outer and inner walls 68 and 70 so as to cool the food container 16. In a particularly preferred embodiment, the inner wall 70 includes apertures 86 which permits the cool air to flow therethrough and onto and around the outer surface of the food container 16 so as to be circulated thereover and cool the food within the food container 16 before being passed over the cooling coil 74 once again.

With reference to FIG. 7, in a particularly preferred embodiment, one portion of the inner wall 70 includes a plurality of apertures 86 which serve as inlet apertures. The air is forced therethrough so as to circulate around the food container 16. Spaced apart from this area is another area, typically opposite the first area, which also includes a plurality of apertures which serve as air inlet apertures which receive the air which has been circulated around the food container 16 and has been warmed due to this contact. The combination of the fan 82 and the spacing of the outlet apertures and inlet apertures 86 substantially eliminates circulation dead spots within the base 14. Other means of improving the circulation may be implemented as well. For example, the air inlet apertures may be defined by small protrusions of the inner wall 70 which serve as nozzles and direct the flow of the air therefrom. For example, the protrusions (not illustrated) may face in opposite directions to force the air to circulate around both sides of the food container 16. The air outlet apertures may be disposed in closer relationship to the food container 16 so as to speed the circulation of air thereover so that it is collected on an opposite side of the food container which has a larger space between the air inlets which serve to capture the now heated air. As shown in FIG. 6, preferably, the air circulates substantially around the complete outer surface of the food container 16 so as to completely cool the contents thereof in the most efficient manner.

Figure 8:
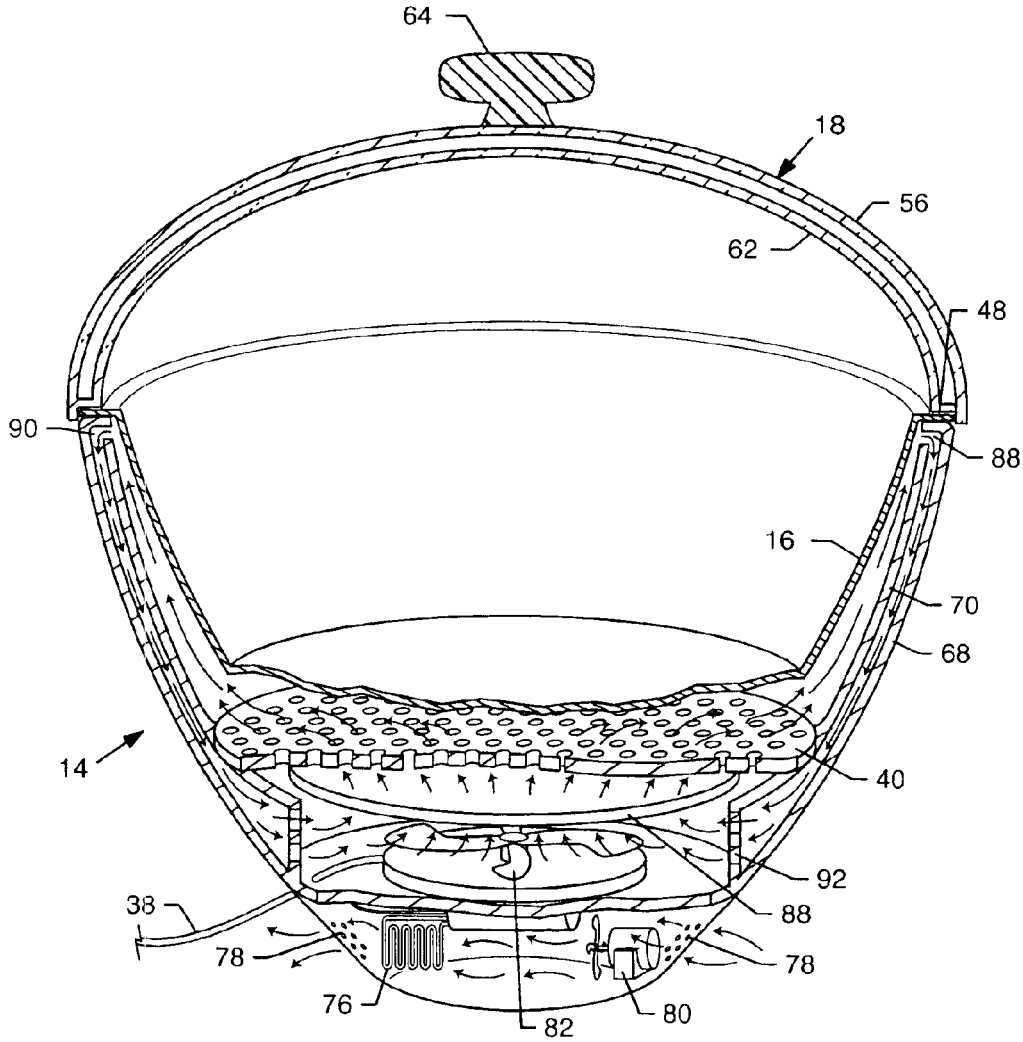
FIG. 8 is a cross-sectional view illustrating yet another portable refrigeration apparatus embodying the present invention, similar to FIG. 6, which is designed to circulate air around an outer surface of the food container which is in substantial sealed relationship with the base of the apparatus.

Other means of improving circulation around the outer surface of the solid food container 16 will be appreciated by those skilled in the art and are contemplated by the present invention. For example, with reference to FIG. 8, an apparatus embodying the present invention is illustrated wherein the base 14 includes a cooling device therein. Such refrigeration or cooling device preferably includes a fan 82 for circulating the air over coils, or as illustrated in FIG. 8 a thermoelectric peltier effect module 88. Above the refrigeration device is an apertured partition 40, which may be formed integrally with the inner wall 70. The solid food container 16 is placed within the base 14 such that the food container 16 substantially seals the base 14 from the outer environment. As discussed above, this may occur due to the interaction of rim 48 of the food container 16 and a corresponding ledge or rim 88 of the base 14, or the sealing nature of the lid 18. In the event that the lid 18 serves to seal the base 14, the food container 16 can be apertured to accommodate fruit and vegetables if so desired. However, in the event that the food container 16 itself serves to seal the interior of the base 14, the food container is comprised of a solid-walled container.

As illustrated with the arrows, air is cooled by the refrigeration device 88 and caused to flow through the apertured wall 40, such as by using fan 82, such that the cooled air flows over the outer surface of the food container 16 disposed within the base 14. Similar to the embodiment illustrated in FIGS. 6 and 7, the cool air flows around the food container 16 and is forced into a circumferential slot, space-apart slots, or apertures 90 formed between the inner and outer walls 70 and 68 of the base 14. Preferably, these slots or apertures 90 are formed towards an upper portion of the base 14 so that the cooled air is forced substantially around the outer surface of the food container 16. As shown by the arrows, the air is then passed between the inner and outer walls 70 and 68 and back to the cooling apparatus within the base 14. Controlling the flow of the air may be accomplished by forcing the air upward using fan 82, which pressure causes the air to flow around the food container 16 and into the outlet apertures or slots 90 so as to flow between the inner and outer walls 70 and 68. Apertures 92 then permit the air to flow back into the cooling device chamber of the base 14 for recirculation.

If deemed necessary, the base 14 may include means for removing the heat from the heat sink portion of the cooling apparatus. This can be as described above, with a fan 80 directing air through aperture 78 and past a heat sink coil or the like 76 of the cooling device and through aperture 78 so as to be dispersed in the environment. The exact design and arrangement of such means is somewhat dependent upon the cooling apparatus utilized. For example, if a thermoelectric module 88 is used, a portion of the module 88 may actually serve as a heat sink and thus the heat would need to be dispersed into the environment. This may or may not require the use of a fan 80. Preferably, the cooled air within the internal cavity of the base 14 entrapped between the food container 16 and base walls 68 and 70 is recirculated to enhance the efficiency of the apparatus. Of course, if the food container 16 and lid 18 are moved, the cool air will be circulated into the environment. Thus, the apparatus should be turned off in such instances or the food container 16 and/or lid 18 be placed on the base 14 within a relatively short time period to prevent unnecessary expense.

Of course, the embodiments illustrated in FIGS. 6–8 are intended to be portable so as to be used on a counter or the like. Thus, the electrical cord 38 can be plugged into a standard wall outlet or provided with an adapter for insertion into a cigarette lighter or the like of an automobile so as to be transported to a party or the like in an automobile. It is also contemplated that the apparatus could be battery powered so as to eliminate the need for an electrical source external of the apparatus.

An important aspect of the embodiment illustrated in FIGS. 6–8 is that the circulated air is not able to enter the solid food container 16 or pass thereover. As discussed above, in some instances, the flow of air over the food is undesirable. For example, such flow of air may cause lettuce and other vegetables to wilt more quickly. Liquid-based dishes may more quickly develop a film or "crustiness" due to the flow of air thereover. Accordingly, the food container 16 and base 14 are configured to form a generally sealed relationship to prevent this air flow. This may be accomplished by having upper portions of each engage one another in a sealing manner. For example, as illustrated, the rim or lip 48 of the food container 16 may rest on a corresponding lip, ledge or rim 88 of the base to form a sealed relationship therebetween. To further facilitate such sealing relationship, a O-ring or other such sealing mechanism may also be employed. It will be appreciated by those skilled in the art that the food container 16 serves to seal the base 14 and trap the cooled air therein. Absent the food container 16, the cool air would migrate from the base 14 and into the environment. However, the sealing arrangement between the base 14 and food container 16 traps the cooled air between the food container 16 and the interior of the base 14.

The lid 18 is adapted to be removably placed over the food container 16. In the context of the embodiments illustrated in FIGS. 6–8, the lid 18 is preferably removably attached either to the food container 16 or base 14 in a sealing relationship so as to prevent air from entering the space between the lid 18 and the food container 16 and causing the undesirable effects described above. The lid 18 may simply rest upon the rim 48 of the food container 16, form a sealing fit with the base 14, or be in snap-fit relationship with either the food container 16 or base 14 to accomplish this intention. This would prevent air from the atmosphere from entering and contaminating or otherwise adversely effecting the food within the food container 16.

The outer surface of base 14 is preferably painted or otherwise decorated so that the apparatus is attractive in one's home. Such decoration will also render the apparatus esthetically pleasing in other settings, such as potluck dinners, social gatherings, and catering situations.

In use, the appropriate food container 16 is selected for the food to be cooled. For example, the colander container 44 may be used for oranges, apples, grapes, or vegetables. Alternatively, as described above, a solid food container 16 is used for other food items such as jell-O, ambrosia, salads, etc. The food-filled container 16 is then placed in base 14 and with lid 18 positioned thereover. The unit is then powered, such as by plugging cord 38 into an electrical outlet, and the proper temperature is selected via thermostat 66. The food can thus be stored conveniently until it is to be transported or eaten. Such is particularly convenient for items which would otherwise become forgotten in a large refrigerator. It is believed that waste from food spoilage would be significantly reduced by using the apparatus of the present invention due to its convenient location on the counter top where family members can readily view the contents thereof through transparent lid 18.

Of course, the apparatus of the present invention can also be used during pot-luck dinners, social gatherings, or by caterers. The apparatus is merely powered and the lid 18 placed on the base 14 to protect the food within container 16 until it is ready for serving. Thus, the apparatus of the present invention can keep food chilled and appetizing even in very adverse conditions, such as the summer heat of a picnic or outdoor party. After a social event, such as in one's home, the host or hostess can go to bed without having to place all of the food in the refrigerator as the food is maintained at the appropriate temperature by the apparatus of the present invention. The apparatus of the present invention can chill food for prolonged periods of time, even continuously, so long as adequate power is supplied thereto. The apparatus of the present invention does so without the accompanying mess associated with cold water or ice arrangements used in the prior art.

Although several embodiments have been described in detail for purposes of illustration, various modifications may be made without departing from the scope and spirit of the invention. Accordingly, the invention is not to be limited, except as by the appended claims.

What is claimed is:

1. A portable refrigeration apparatus, comprising:

a base defining an open interior cavity;

a food container configured to be removably disposed within the interior cavity of the base; and an electric refrigeration unit operably associated with the base for cooling and circulating air such that the food container is cooled;

wherein the base and food container are arranged such that cool air is prevented from entering into or passing over the food container; and wherein an upper portion of the food container engages with an upper portion of the base to form a seal to prevent cool air from passing therebetween; and includes an outer wall and a inner wall spaced from the outer wall to permit air flow therebetween.

2. The apparatus of claim 1, wherein the food container is configured to be removably disposed within the interior cavity of the base in a generally sealed relationship therewith to trap the cool air therebetween.

3. The apparatus of claim 1, wherein the base is generally concave.

4. The apparatus of claim 1, wherein at least a portion of the inner wall includes apertures for permitting cool air to flow therethrough and onto an outer surface of the food container.

5. The apparatus of claim 4, wherein a first portion of the inner wall includes air outlet apertures and a second portion of the inner wall, spaced from the first portion, includes air inlet apertures.

6. The apparatus of claim 1 wherein an upper lip of the food container sealingly engages an upper lip of the base.

7. The apparatus of claim 1, including a lid removably disposable over the food container.

8. The apparatus of claim 7, wherein the lid is adapted to sealingly engage with either the food container or the base so as to generally prevent air from entering the food container.

9. The apparatus of claim 1, wherein the base is insulated.

10. The apparatus of claim 1, wherein the food container is compartmentalized to accommodate different food items.

11. The apparatus of claim 1, wherein the refrigeration unit comprises a compressor, a cooling coil coupled to the compressor and a fan for circulating cool air.

12. The apparatus of claim 1, wherein the refrigeration unit comprises a thermoelectric couple device.

13. The apparatus of claim 1, including a temperature control mechanism coupled to the refrigeration unit.

14. A portable refrigeration apparatus, comprising:

a base defining an open interior cavity;

a food container configured to be removably disposed within the interior cavity of the base;

a lid removably disposable over the food container; and an electric refrigeration unit operably associated with the base for cooling and circulating air such that the food container is cooled;

wherein the base and food container are arranged such that cool air is prevented from entering into or passing over the food container.

15. The apparatus of the food container is configured to be removably disposed within the interior cavity of the base in a generally sealed relationship therewith to trap the cool air therebetween.

16. The apparatus of claim 14, wherein the base is generally concave.

17. The apparatus of claim 14, wherein at least a portion of the inner wall includes apertures for permitting cool air to flow therethrough and onto an outer surface of the food container.

18. The apparatus of claim 17, wherein a first portion of the inner wall includes air outlet apertures and a second portion of the inner wall, spaced from the first portion, includes air inlet apertures.

19. The apparatus of claim 14, wherein an upper portion of the food container engages with an upper portion of the base to form a seal to prevent cool air from passing therebetween.

20. The apparatus of claim 19, wherein an upper lip of the food container sealingly engages an upper lip of the base.

21. The apparatus of claim 14, wherein the lid is adapted to sealingly engage with either the food container or the base so as to generally prevent air from entering the food container and includes an outer wall and a inner wall spaced from the outer wall to permit air flow therebetween.

22. The apparatus of claim 14, wherein the base is insulated.

23. The apparatus of claim 14, wherein the food container is compartmentalized to accommodate different food items.

24. The apparatus of claim 14, wherein the refrigeration unit comprises a compressor, a cooling coil coupled to the compressor and a fan for circulating cool air.

25. The apparatus of claim 14, wherein the refrigeration unit comprises a thermoelectric couple device.

26. The apparatus of claim 14, including a temperature control mechanism coupled to the refrigeration unit.

27. A portable refrigeration apparatus, comprising:

a base defining an open interior cavity;

a food container configured to be removably disposed within the interior cavity of the base; and an electric refrigeration unit operably associated with the base for cooling and circulating air such that the food container is cooled;

wherein the food container is compartmentalized to accommodate different food items; and wherein the base and food container are arranged such that cool air is prevented from entering into or passing over the food container.

28. The apparatus of claim 27, wherein the food container is configured to be removably disposed within the interior cavity of the base in a generally sealed relationship therewith to trap the cool air therebetween.

29. The apparatus of claim 27, wherein the base is generally concave.

30. The apparatus of claim 27, wherein at least a portion of the inner wall includes apertures for permitting cool air to flow therethrough and onto an outer surface of the food container.

31. The apparatus of claim 30, wherein a first portion of the inner wall includes air outlet apertures and a second portion of the inner wall, spaced from the first portion, includes air inlet apertures.

32. The apparatus of claim 27, wherein an upper portion of the food container engages with an upper portion of the base to form a seal to prevent cool air from passing therebetween.

33. The apparatus of claim 32, wherein an upper lip of the food container sealingly engages an upper lip of the base.

34. The apparatus of claim 27, including a lid removably disposed over the food container; and includes an outer wall and a inner wall spaced from the outer wall to permit air flow therebetween.

35. The apparatus of claim 34, wherein the lid is adapted to sealingly engage with either the food container or the base so as to generally prevent air from entering the food container.

36. The apparatus of claim 27, wherein the base is insulated.

37. The apparatus of claim 27, wherein the refrigeration unit comprises a compressor, a cooling coil coupled to the compressor and a fan for circulating cool air.

38. The apparatus of claim 27, wherein the refrigeration unit comprises a thermoelectric couple device.

39. The apparatus of claim 27, including a temperature control mechanism coupled to the refrigeration unit.

* * * * *